US007899373B2

(12) United States Patent
Yamagishi et al.

(10) Patent No.: US 7,899,373 B2
(45) Date of Patent: Mar. 1, 2011

(54) DEVELOPING DEVICE AND IMAGE FORMING APPARATUS

(75) Inventors: Yoshihiro Yamagishi, Osaka (JP); Masaki Hayashi, Osaka (JP)

(73) Assignee: Kyocera Mita Corporation (JP)

( * ) Notice: Subject to any disclaimer, the term of this patent is extended or adjusted under 35 U.S.C. 154(b) by 582 days.

(21) Appl. No.: 12/020,611

(22) Filed: Jan. 28, 2008

(65) Prior Publication Data

US 2008/0181676 A1 Jul. 31, 2008

(30) Foreign Application Priority Data

Jan. 31, 2007 (JP) ..... 2007-021011

(51) Int. Cl.
*G03G 15/08* (2006.01)

(52) U.S. Cl. ..... 399/275; 399/284

(58) Field of Classification Search ..... 399/274, 399/275, 284
See application file for complete search history.

(56) References Cited

U.S. PATENT DOCUMENTS 4,637,706 A * 1/1987 Hosoi et al. ..... 399/275
5,072,690 A * 12/1991 Ishikawa et al. ..... 399/275
6,035,169 A * 3/2000 Miyake et al. ..... 399/258

FOREIGN PATENT DOCUMENTS

JP 2003-167426 6/2003

* cited by examiner

*Primary Examiner* — David M Gray
*Assistant Examiner* — Gregory H Curran
(74) *Attorney, Agent, or Firm* — Gerald E. Hespos; Michael J. Porco

(57) ABSTRACT

A developing device using a magnetic mono-component developing agent includes a rotary sleeve that accommodates a stationary magnet, and a toner layer thickness regulating member that regulates a thickness of a toner layer formed on the rotary sleeve. The toner layer thickness regulating member includes a blade formed of a plate-like member made of a magnetic material and a magnet attached to the blade on a side upstream in a rotation direction of the rotary sleeve. The magnet is disposed in such a manner that a direction of a magnetic field generated in a portion of the magnet on a side of the rotary sleeve is almost in parallel with the rotation direction of the rotary sleeve.

15 Claims, 8 Drawing Sheets

DEVELOPING DEVICE AND IMAGE FORMING APPARATUS

BACKGROUND OF THE INVENTION

1. Field of the Invention

The present invention relates to a developing device that forms a toner image by supplying a magnetic developing agent toward an image carrier on which an electrostatic latent image is formed by an electrophotographic method, and an image forming apparatus equipped with the developing device.

2. Description of the Related Art

A developing device applied to an image forming apparatus adopting an electrophotographic method forms a toner image by supplying toner particles as a developing agent toward the peripheral surface of the photoconductive drum on which an electrostatic latent image is formed according to image data. The image forming apparatus equipped with such a developing device transfers the toner image formed on the photoconductive drum onto a recording medium, such as a sheet. The transferred toner image is fixed onto the recording medium by heating and applying a pressure to the recording medium by a fixing device provided downstream of the photoconductive drum in the sheet transportation direction. By these operations, the image forming apparatus forms an image according to the image data on the recording medium.

The developing device is provided with a rotary sleeve to supply toner particles to the photoconductive drum, and a blade is provided at a position upstream of the position at which the rotary sleeve and the photoconductive drum oppose each other in the rotation direction of the rotary sleeve. By regulating the thickness of a toner layer that is formed thick on the rotary sleeve with the blade, it is possible to prevent an excessive supply of toner particles to the photoconductive drum. The developing device configured in this manner is therefore able to supply toner particles in a homogeneous state to the photoconductive drum via the rotary sleeve.

As a developing device using a magnetic mono-component developing agent (magnetic toner particles), there is known, for example, a magnetic mono-component developing device that regulates the thickness of a toner layer made up of magnetic toner particles on the rotary sleeve accommodating a stationary magnet using a non-contact magnetic blade. In such a magnetic mono-component developing device, when the toner layer formed thick on the rotary sleeve passes by the position at which the rotary sleeve and the magnetic blade oppose each other (hereinafter, referred to as the layer thickness regulating position), the toner layer is divided in two between the rotary sleeve and the magnetic blade. Toner particles closer to the magnetic blade adhere to the magnetic blade and toner particles closer to the rotary sleeve move away from the magnetic blade as they are attracted to the rotary sleeve by a magnetic attraction force of the stationary magnet accommodated in the rotary sleeve. In this manner, the magnetic mono-component developing device regulates the thickness of the toner layer without the magnetic blade contacting with the rotary sleeve instead of scarping off the toner layer using the blade. Accordingly, the magnetic mono-component developing device has minor damage on the magnetic toner particles, the blade, and the rotary sleeve even when high-speed printing is executed, and is therefore suitably applied to an image forming apparatus that requires high-speed printing and high durability.

However, because the magnetic mono-component developing device regulates the thickness of the toner layer with the magnetic attraction force of the stationary magnet accommodated in the rotary sleeve or the like, it is susceptible to the surrounding environment, such as the charging property of toner particles, free fine toner particles, an external additive to toner particles, and the surface nature of the rotary sleeve. Accordingly, disturbance may possibly occur in the toner layer whose layer thickness has been regulated, and the toner layer formed under such a condition may have irregularities in density.

As a developing device that reduces the occurrence of irregularities in density in the toner layer as above, there is known a developing device as described in JP-A-2003-167426 (Reference D1), in which a magnet is attached to the surface of the blade on the side upstream in the rotation direction of the rotary sleeve.

The developing device described in Reference D1 is able to regulate the thickness of the toner layer without disturbing the toner layer when a strong magnetic field is generated at the end surface of the blade on the rotary sleeve side by the magnet attached to the blade, and a homogeneous toner layer having little irregularities in density can be obtained. However, depending on the location of the magnet attached to the blade, there may be a case where a strong magnetic field is also generated on the end surface of the magnet on the rotary sleeve side. In such a case, a large amount of magnetic toner particles adhere to the end surface of the magnet on the rotary sleeve side. In a case where the developing device is used over a long period or at a high temperature in this state, toner particles adhering to the magnet aggregate to form clusters. When such aggregated toner particles enter at the layer thickness regulating position, a part mixed with the aggregate toner particles is in a condition that the thickness and the charging state of the toner layer are different from those in the other parts. This gives rise to a streak-like image defect.

SUMMARY OF THE INVENTION

An object of the invention is to provide a developing device not only capable of forming a toner layer having little irregularities in density but also capable of preventing the occurrence of an image defect. Also, another object is to provide an image forming apparatus equipped with such a developing device.

A developing device using a magnetic mono-component developing agent according to one aspect of the invention to achieve the above and other objects includes: a rotary sleeve that accommodates a stationary magnet; and a toner layer thickness regulating member that regulates a thickness of a toner layer formed on the rotary sleeve. The toner layer thickness regulating member includes a blade formed of a plate-like member made of a magnetic material, and a magnet attached to the blade on a side upstream in a rotation direction of the rotary sleeve. The magnet is disposed in such a manner that a direction of a magnetic field generated in a portion of the magnet on a side of the rotary sleeve is almost in parallel with the rotation direction of the rotary sleeve.

An image forming apparatus according to another aspect of the invention includes an image carrier on which an electrostatic latent image is to be formed, and a developing device that develops the electrostatic latent image formed on the image carrier by supplying a magnetic mono-component developing agent to the image carrier. The developing device has the configuration described above.

DETAILED DESCRIPTION OF THE PREFERRED EMBODIMENTS

An example of an image forming apparatus equipped with a developing device according to one embodiment of the invention will be described. A copying machine will be described as an example of the image forming apparatus. It should be appreciated, however, that the image forming apparatus is not limited to a copying machine, and it may be a facsimile machine, a printer, and so forth. Also, a photoconductive drum, which is a drum-shaped photoconductor, will be described as an example of an image carrier. It should be appreciated, however, that the image carrier is not limited to a photoconductive drum, either, and the invention is also applicable to a belt of photoconductor and a sheet of photoconductor.

Figure 1:
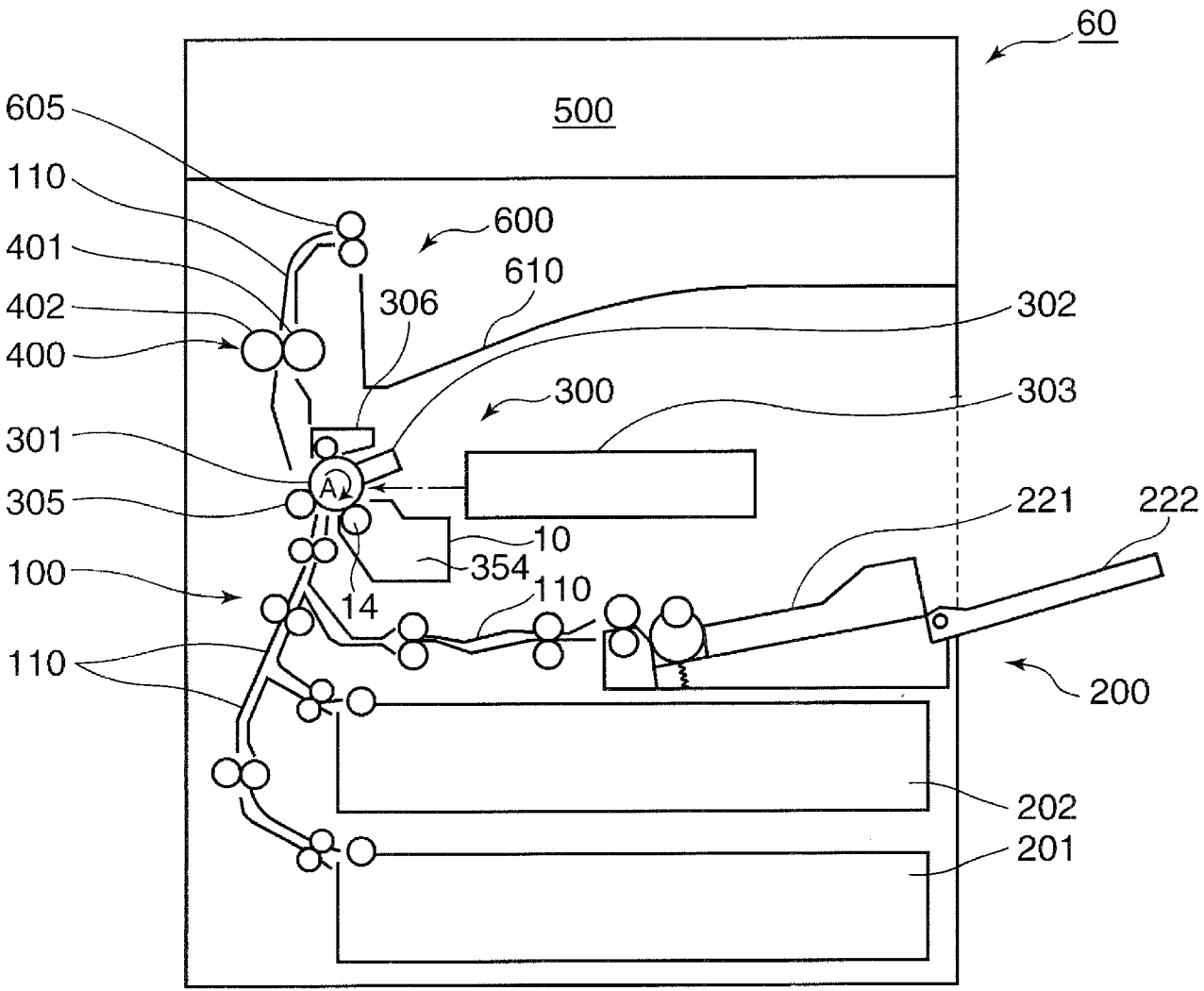
FIG. 1 is a view schematically showing the configuration of an image forming apparatus (copying machine) equipped with a developing device according to one embodiment of the invention.

FIG. 1 is a view schematically showing the configuration of an image forming apparatus (copying machine) 60 equipped with a developing device according to one embodiment of the invention. The copying machine 60 is a so-called body-inside sheet discharging type copying machine, including a sheet feeing portion 200 provided at the bottom of the copying machine main body, an image forming portion 300 provided above the sheet feeding portion 200, a fixing portion 400 provided closer to the discharging side than the image forming portion 300, an image reading portion 500 provided on the top portion of the copying machine main body, and a sheet discharging portion 600 disposed between the copying machine main body and the image reading portion 500. The copying machine main body is provided with a sheet transportation portion 100 that interconnects the sheet feeding portion 200, the image forming portion 300, the fixing portion 400, and the sheet discharging portion 600.

The image forming portion 300 forms a specific toner image on a sheet by an electrophotographic process, and includes a photoconductive drum 301 axially supported to be rotatable, and a charging unit 302, an exposing unit 303, a developing unit (developing device) 10, a transfer unit 305, and a cleaner 306 disposed on the periphery of the photoconductive drum 301 along the rotation direction A. The developing unit 10 forms a toner image on the surface of the photoconductive drum 301 by developing an electrostatic latent image using toner particles.

The fixing portion 400 is disposed downstream of the image forming portion 300 in the sheet transportation direction. It nips a sheet on which is transferred a toner image in the image forming portion 300 and heats and applies a pressure to the sheet using a pair of rollers (a heating roller 401 and a pressure roller 402) and thereby fixes the toner image on the sheet.

The image reading portion 500 reads image information of an original by irradiating light from an exposing lamp to the original placed on the contact glass and introducing reflected light to a photo-electric converting portion via a reflection mirror.

The sheet feeding portion 200 includes plural sheet feeding cassettes 201, 202, and 221. Of these cassettes, the sheet feeding cassette 221 serves as a bypass tray used to replenish sheets from the side surface of the copying machine, and it can be closed with a cover portion 222.

Figure 2:
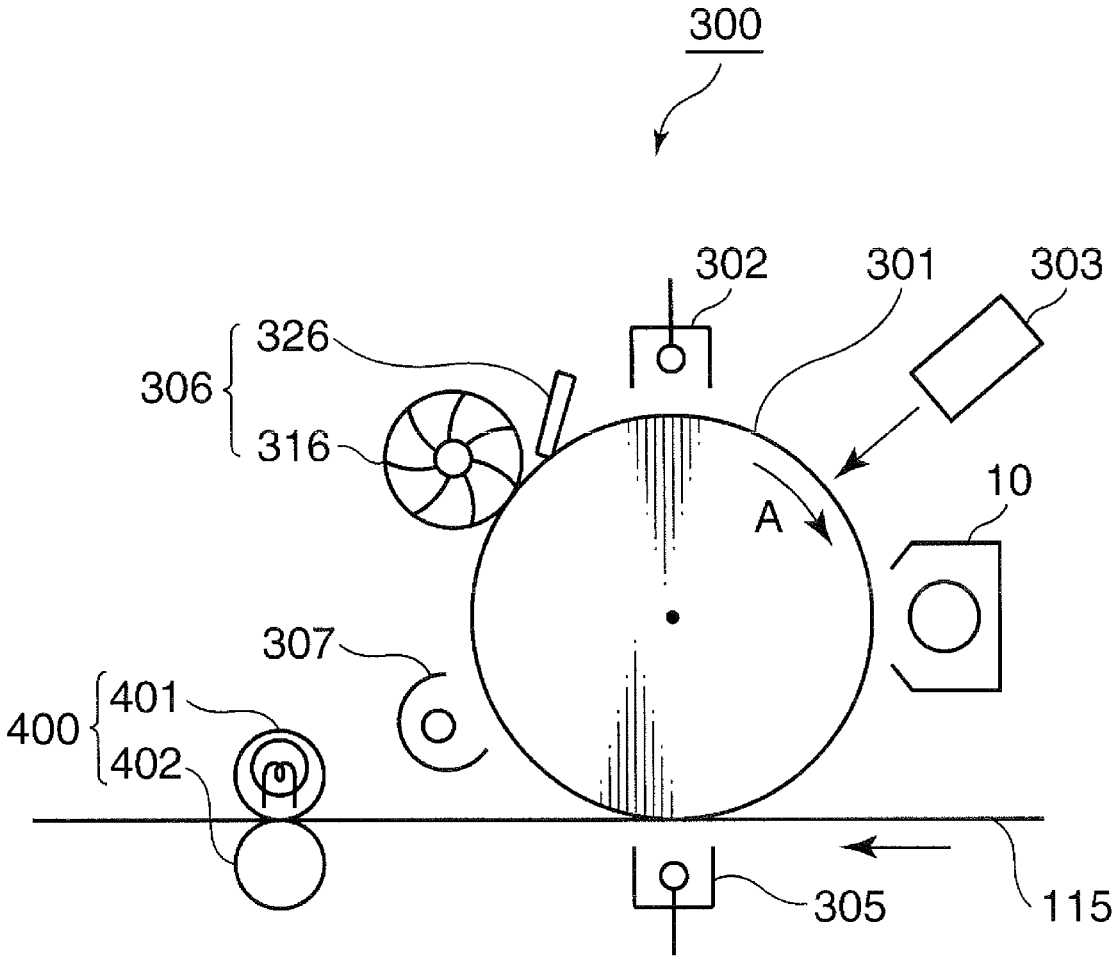
FIG. 2 is a schematic view showing the periphery of an image forming portion in the image forming apparatus in FIG. 1.

Sheet transportation paths 110 are connected to the respective sheet feeding cassettes 201, 202, and 221. The sheet transportation paths 110 are headed for the image forming portion 300 and further to the sheet discharging portion 600 by way of the fixing portion 400. These transportation paths 110 together form the sheet transportation portion 100. A sheet after the completion of the copying operation is discharged onto a discharge tray 610 from a discharging roller pair 605 in the sheet discharging portion FIG. 2 is a schematic view showing the periphery of the image forming portion 300 in the image forming apparatus, such as the copying machine 60 of FIG. 1. The image forming portion 300 is a portion where a specific toner image is formed on a recording sheet 115 by the electrophotographic process. It includes the charging unit 302, the exposing unit 303, the developing unit 10, the transfer unit 305, a static eliminating unit 307, and the cleaner 306 provided sequentially on the periphery of the photoconductive drum 301 having photosensitivity along the rotation direction A of the photoconductive drum 301. The locations of the static eliminating unit 307 and the cleaner 306 may be exchanged.

The charging unit 302 provides specific potential to the surface of the photoconductive drum 301 through generation of a corona discharge. The exposing unit 303 forms an electrostatic latent image by irradiating light corresponding to a desired image on the surface of the photoconductive drum 301 to selectively attenuate the surface potential. The developing unit 10 forms a toner image by developing the electrostatic latent image formed on the surface of the photoconductive drum 301 with toner particles. The transfer unit 305 transfers the toner image formed on the photoconductive drum 301 onto a recording sheet 115. The static eliminating unit 307 eliminates surface charges on the photoconductive drum 301 using lamp light. The cleaner 306 is formed of a fur brush 316 and a rubber blade 326, and removes toner particles and additives thereof remaining on the surface of the photoconductive drum 301. The cleaner 306 shown in the drawing as an example has both the fur brush 316 and the rubber blade 326. It should be noted, however, that there is a cleaner having only one of these components.

Heat and a pressure are applied to the recording sheet 115 on which is transferred the toner image in the image forming portion 300 by the fixing portion 400 (the heating roller 401 and the pressure roller 402), and the toner image is fixed thereon. Subsequently, the recording sheet 115 is discharged onto the sheet discharge tray 610 by the sheet discharging roller pair 605 shown in FIG. 1.

Hereinafter, the developing unit (developing device) 10 according to one embodiment of the invention used in the copying machine will be described.

Figure 3:
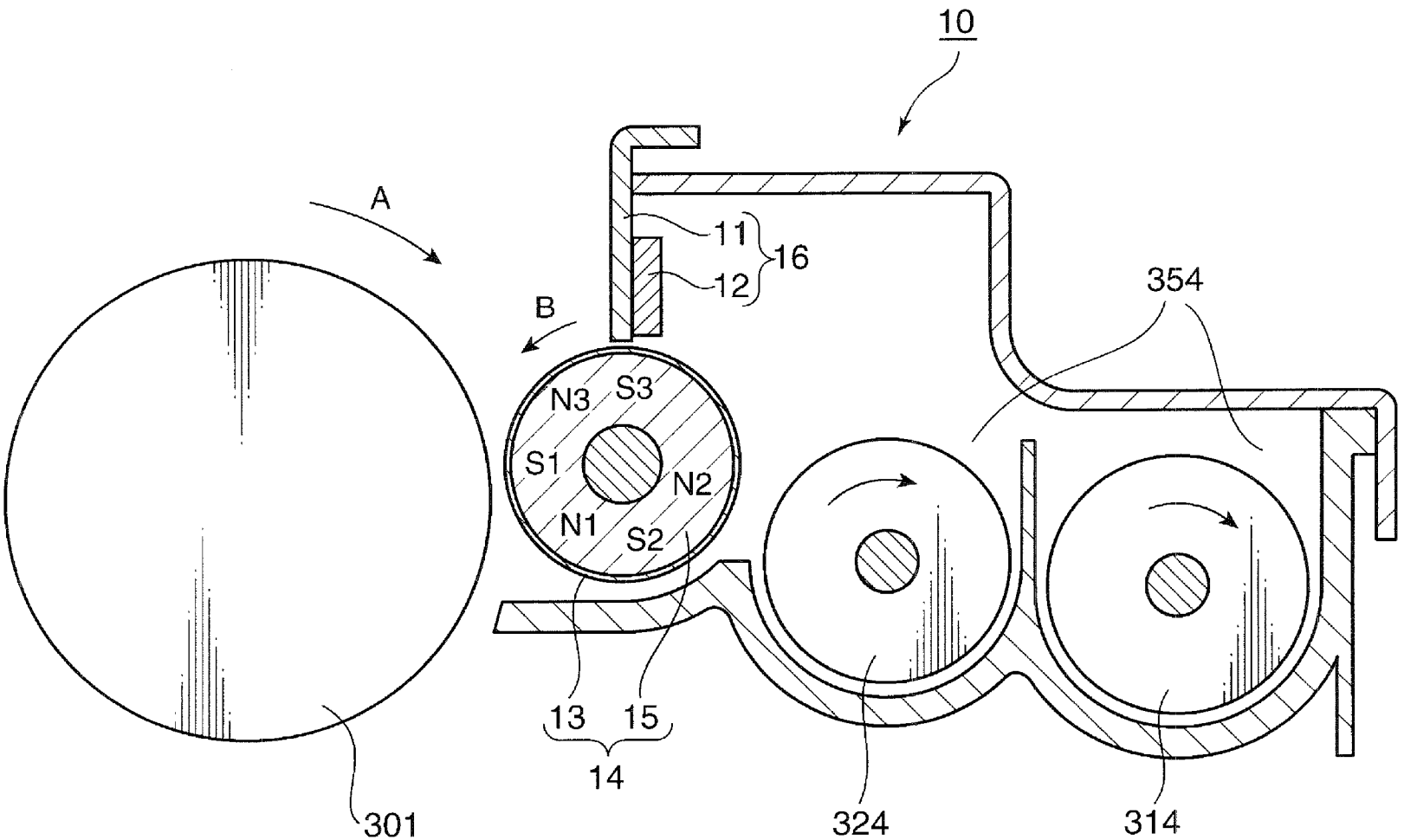
FIG. 3 is a cross section showing a developing unit (developing device) shown in FIG. 2.

FIG. 3 is a cross section showing the developing unit (developing device) 10 shown in FIG. 2 together with the photoconductive drum 301. An unillustrated magnetic monocomponent developing agent (toner particles) is accommodated in toner storing portions 354 of the developing unit 10, and two stirring rollers 314 and 324 that stir toner particles and a developing roller 14 that forces toner particles to migrate onto the surface of the photoconductive drum 301 are provided.

The developing roller 14 is formed of a cylindrical rotary sleeve 13 made of a non-magnetic material, such as aluminum, and a stationary magnet 15 accommodated in the rotary sleeve 13. It is configured in such a manner that the rotary sleeve 13 rotates about the stationary magnet 15 while the position thereof is fixed. In addition, a toner layer thickness regulating member 16 is provided oppositely to the rotary sleeve 13 of the developing roller 14.

The stationary magnet 15 is a magnet of the 6-pole structure with the magnetic poles disposed as follows. An S pole (developing pole S1) is disposed at a position opposing the photoconductive drum 301 and another S pole (blade pole S3) is disposed at a position opposing the toner layer thickness regulating member 16. An N pole (N1), an S pole (S2), and an N pole (N2) are sequentially disposed downstream of the developing pole S1 in the rotation direction B of the rotary sleeve 13. Further, an N pole (N3) is disposed downstream of the blade pole S3 in the rotation direction B of the rotary sleeve 13.

The toner layer thickness regulating member 16 is formed of a blade 11 and a magnet 12. The blade 11 is disposed in a direction perpendicular to the rotation direction B of the rotary sleeve 13, and the magnet 12 is attached to the surface of the blade 11 on the side upstream in the rotation direction B of the rotary sleeve 13.

Figure 4:
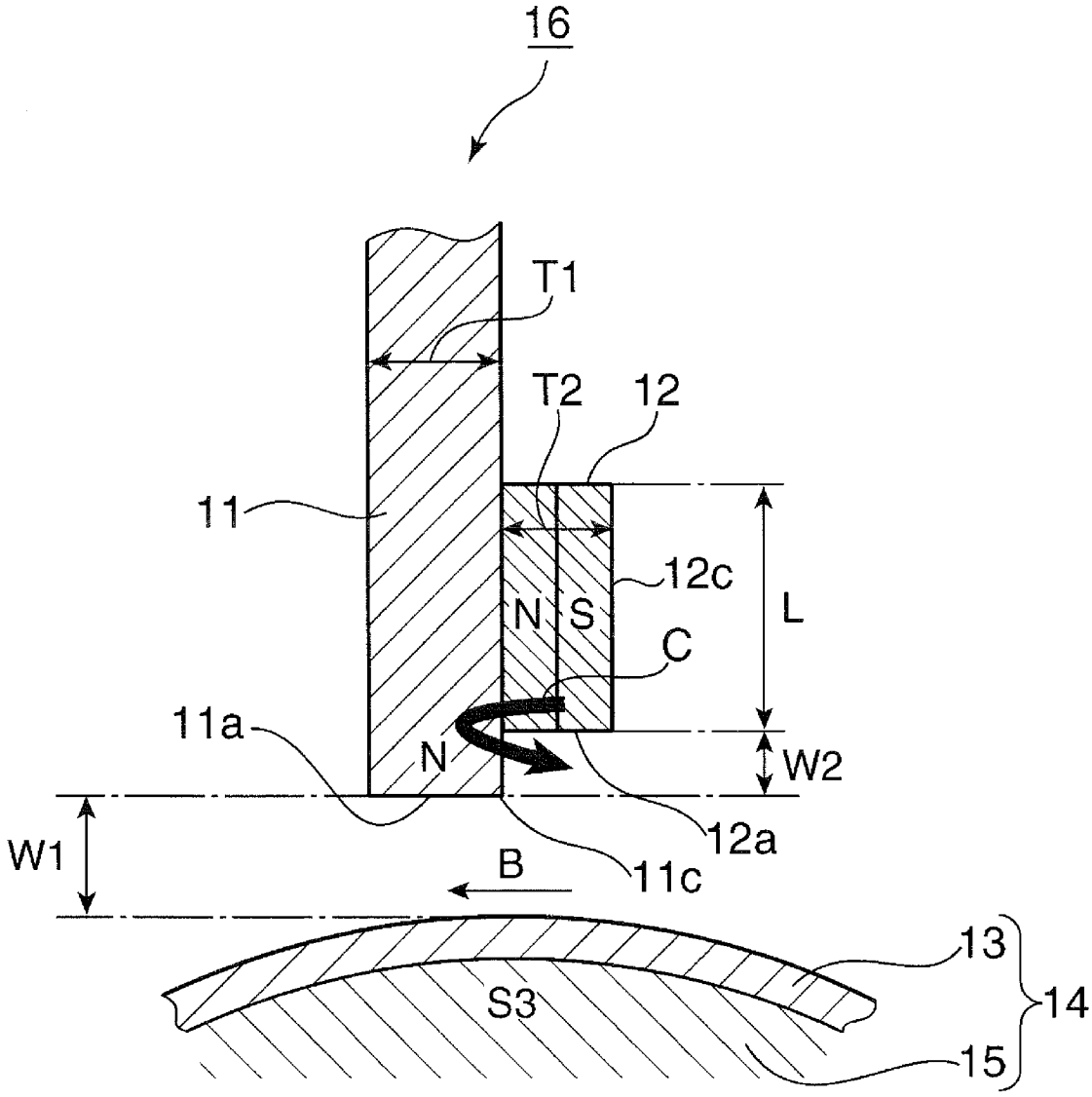
FIG. 4 is a partially enlarged cross section showing a developing roller and a toner layer thickness regulating member shown in FIG. 3.

FIG. 4 is a partially enlarged cross section showing the developing roller 14 and the toner layer thickness regulating member 16 shown in FIG. 3. The blade 11 is formed of a plate-like member made of a magnetic material. Examples of the plate-like member made of a magnetic material include but not limited to SUS340 and SUS430, and SUS430 is used preferably. The blade 11 has an end surface 11*a* opposing the rotary sleeve 13. The end surface 11*a* is also referred to as the end face 11*a* of the blade 11 on the rotary sleeve side herein. The end surface 11*a* of the blade 11 on the rotary sleeve side is provided to extend in parallel with the axial direction of the rotary sleeve 13 while being spaced apart from the rotary sleeve 13 by a specific interval W1. The specific interval W1 is preferably 0.2 to 0.4 mm, and for example, 0.3 mm. When W1 is too narrow, there is a tendency that toner particles readily clog in a space between the blade 11 and the rotary sleeve 13. Conversely, when W1 is too wide, there is a tendency that irregularities in density readily occur in the toner layer. The thickness T1 of the blade 11 can be any thickness as long as it is sufficient to firmly maintain the position of the end surface 11*a* on the rotary sleeve side without bending, and for example, 2 mm. In addition, the magnet 12 has an end surface 12*a* opposing the rotary sleeve 13. The end surface 12*a* is also referred to as the end face 12*a* of the magnet 12 on the rotary sleeve side herein. It is preferable that the end surface 12*a* of the magnet 12 on the rotary sleeve side is at a position farther from the rotary sleeve 13 than the end surface 11*a* of the blade 11 on the rotary sleeve side. A distance between the end surface 11*a* of the blade 11 on the rotary sleeve side and the end surface 12*a* of the magnet 12 on the rotary sleeve side, that is, a protrusion length W2 of the blade 11 with respect to the magnet 12 is preferably 0.3 to 0.8 mm, and for example, 0.5 mm. When W2 is too narrow, there is a tendency that toner particles readily clog in a space between the blade 11 and the rotary sleeve 13 in a case where a small amount of toner particles adhere to the end surface 12*a* of the magnet 12 on the rotary sleeve side. Conversely, when W2 is too wide, there is a tendency that the magnet 12 can no longer be disposed in the manner as described below (disposed so that the direction C of the magnetic field is almost in parallel with the rotation direction B of the rotary sleeve 13).

The magnet 12 is a plate-like magnet disposed in parallel with the plane direction of the blade 11. It is sufficient for the magnet 12 to generate a specific magnetic field, and the thickness T2 thereof is, for example, 4 mm, the length L thereof is, for example, 5 mm, and the length in parallel with the shaft center direction of the developing roller 14 is, for example, 218 mm. The magnet 12 has a magnetization direction perpendicular to the plane direction of the blade 11. To be more concrete, the lamination surface side in contact with the blade 11 serves as an N pole, which has a polarity different from that of the magnetic pole (blade pole S3) formed in a portion of the stationary magnet 15 included in the developing roller 14 so as to oppose the blade 11, whereas the open surface side not in contact with the blade 11 serves as an S pole, which has the polarity same as that of the blade pole S3. In other words, in this embodiment, the stationary magnet 15 included in the developing roller 14 has a first magnetic pole (S pole) disposed at a position opposing the toner layer thickness regulating member 16, whereas the magnet 12 has a second magnetic pole (N pole) formed on the lamination surface side in contact with the blade 11 to have a polarity different from that of the first magnetic pole and another magnetic pole (S pole) formed on the open surface side not in contact with the blade 11 to have the same polarity as the first magnetic pole. In other words, the magnet 12 is disposed in such a manner that the direction (a direction in which the magnetic field line is oriented) C of the magnetic field generated in a portion of the magnet 12 on the rotary sleeve side is almost in parallel with the rotation direction B of the rotary sleeve 13 (a direction in which the outer surface of the rotary sleeve 13 moves).

Figure 5:
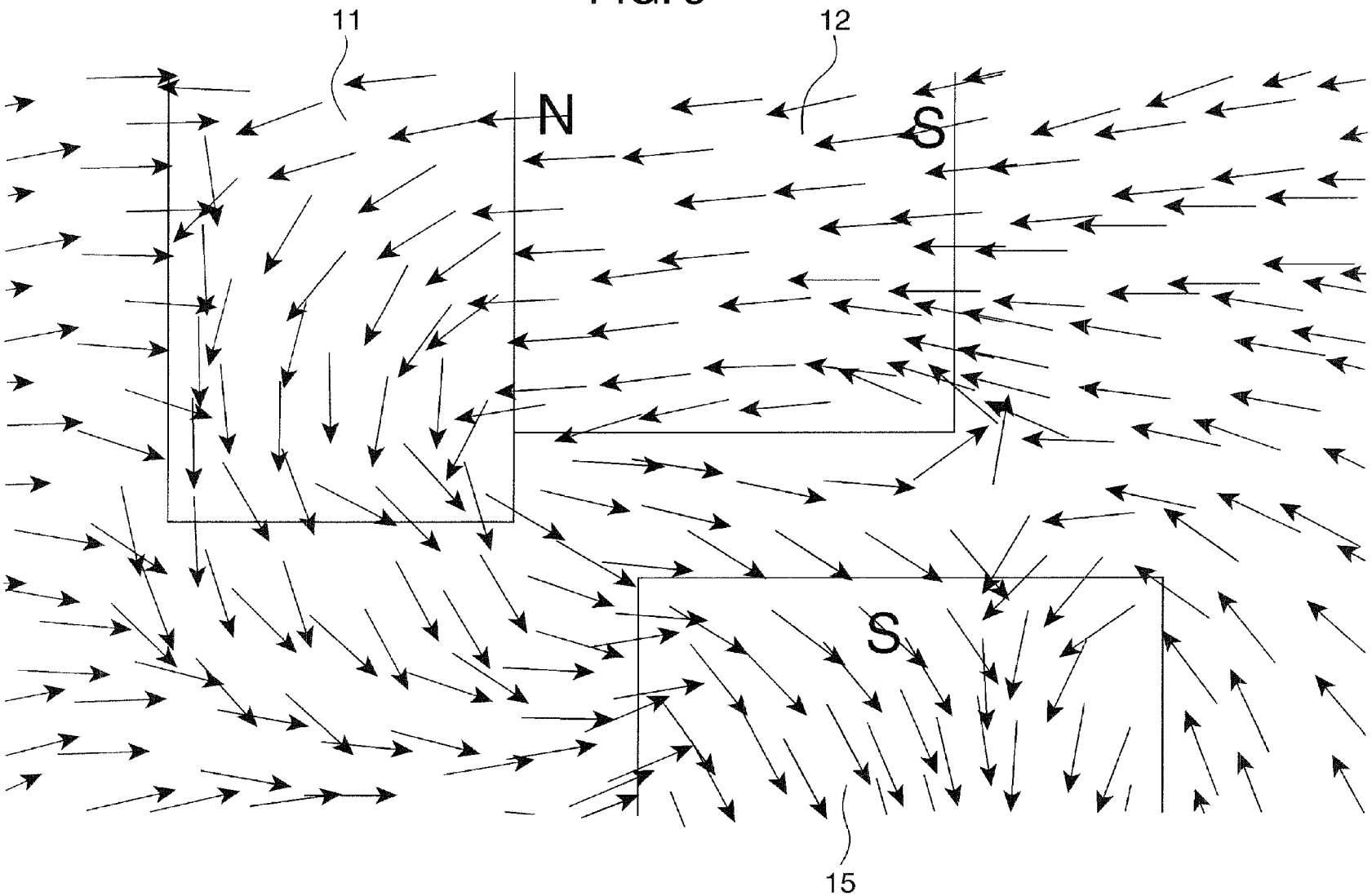
FIG. 5 is a view showing the result of the analysis on magnetic fields in a case where magnetic poles are formed in the positional relation as specified in FIG. 4.

FIG. 5 is a view showing the result of the analysis on the magnetic fields when magnetic poles are formed in the positional relation as specified in FIG. 4. The magnetic fields were analyzed by making a distance between the magnet 12 and the stationary magnet 15 shorter than the actual distance in order to make a difference from a comparative embodiment described below easy to understand by indicating the directions of the magnetic fields clearly. As can be understood from FIG. 5, the magnet 12 disposed in the positional relation as specified in FIG. 4 is disposed in such a manner that the direction C of the magnetic field generated in a portion of the magnet 12 on the rotary sleeve side is almost in parallel with the rotation direction B of the rotary sleeve 13.

It is sufficient to dispose the magnet 12 so that the direction C of the magnetic field is almost in parallel with the rotation direction B of the rotary sleeve 13 as described above, and the magnet 12 does not necessarily have to be disposed according to the positional relation as specified in FIG. 4.

In the developing unit 10, a strong magnetic field is generated at the layer thickness regulating position by the S3 pole in the stationary magnet 15 and the S pole on the end surface 12*c* of the magnet 12 on the open surface side. In addition, as can be understood from the fact that the direction C of the magnetic field as described above is formed on the end surface 11*a* of the blade 11 on the rotary sleeve side, a strong N pole is induced. Further, because a magnetic field is generated in a portion of the magnet 12 on the rotary sleeve side in such a manner that the direction C of the magnetic field is almost in parallel with the rotation direction B of the rotary sleeve 13, a strong magnetic pole is not formed on the end surface 12*a* of the magnet 12 on the rotary sleeve side.

Hereinafter, operations of the developing unit 10 will be described.

Toner particles inside the toner storing portions 354 in the developing unit 10 are attracted by magnetic forces of the N2 pole and the N3 pole in the stationary magnet 15 and transported to the layer thickness regulating position while being moved upward by rotations of the rotary sleeve 13. In this instance, because a strong magnetic field has been generated between the blade 11 and the rotary sleeve 13 by the N pole on the end surface 11*a* of the blade 11 on the rotary sleeve side and the S3 pole in the stationary magnet 15, the toner layer passes by the layer thickness regulating position in an almost homogeneous state where irregularities in density are reduced to an extremely low extent. When the toner layer moves away from the layer thickness regulating position, toner particles closer to the blade 11 adhere to the blade 11 owing to the N pole on the end surface 11*a* of the blade 11 on the rotary sleeve side. Meanwhile, toner particles closer to the rotary sleeve 13 are attracted toward the rotary sleeve 13 by the S3 pole in the stationary magnet 15 and move away from the blade 11. In this manner, the toner layer on the rotary sleeve 13 is divided in two in a homogeneous state so that the layer thickness is regulated. Thereafter, the toner thin layer whose layer thickness is regulated and made thin is headed for the photoconductive drum 301.

As has been described, in this embodiment, because a strong N pole is induced on the end surface 11*a* of the blade 11 on the rotary sleeve side by the magnet 12 in the toner layer thickness regulating member 16, a strong magnetic force acts between the blade 11 and the rotary sleeve 13. This makes the toner layer at the layer thickness regulating position least susceptible to the environment other than this strong magnetic force. Consequently, disturbance in the toner layer at the layer thickness regulating position is eliminated. It is thus possible to form an almost homogeneous toner layer having little irregularities in density even when the layer thickness is regulated.

Further, because a strong magnetic pole is not formed on the end surface 12*a* of the magnet 12 on the rotary sleeve side, toner particles hardly adhere to the end surface 12*a* of the magnet 12 on the rotary sleeve side. It is thus possible to prevent the occurrence of an image defect resulting from aggregated toner particles.

As has been described, the developing device 10 configured as above is not only capable of forming the toner layer having little irregularities in density, but is also capable of preventing the occurrence of an image defect.

A developing device 20 in which the magnet 12 is located differently from the invention will now be described as a comparative embodiment for the purpose of comparison with the invention. Because the developing device 20 is the same as the developing device 10 of the invention except for the location of the magnet 12, like components are labeled with like reference numerals with respect to FIG. 4 and descriptions will not be repeated herein.

Figure 6:
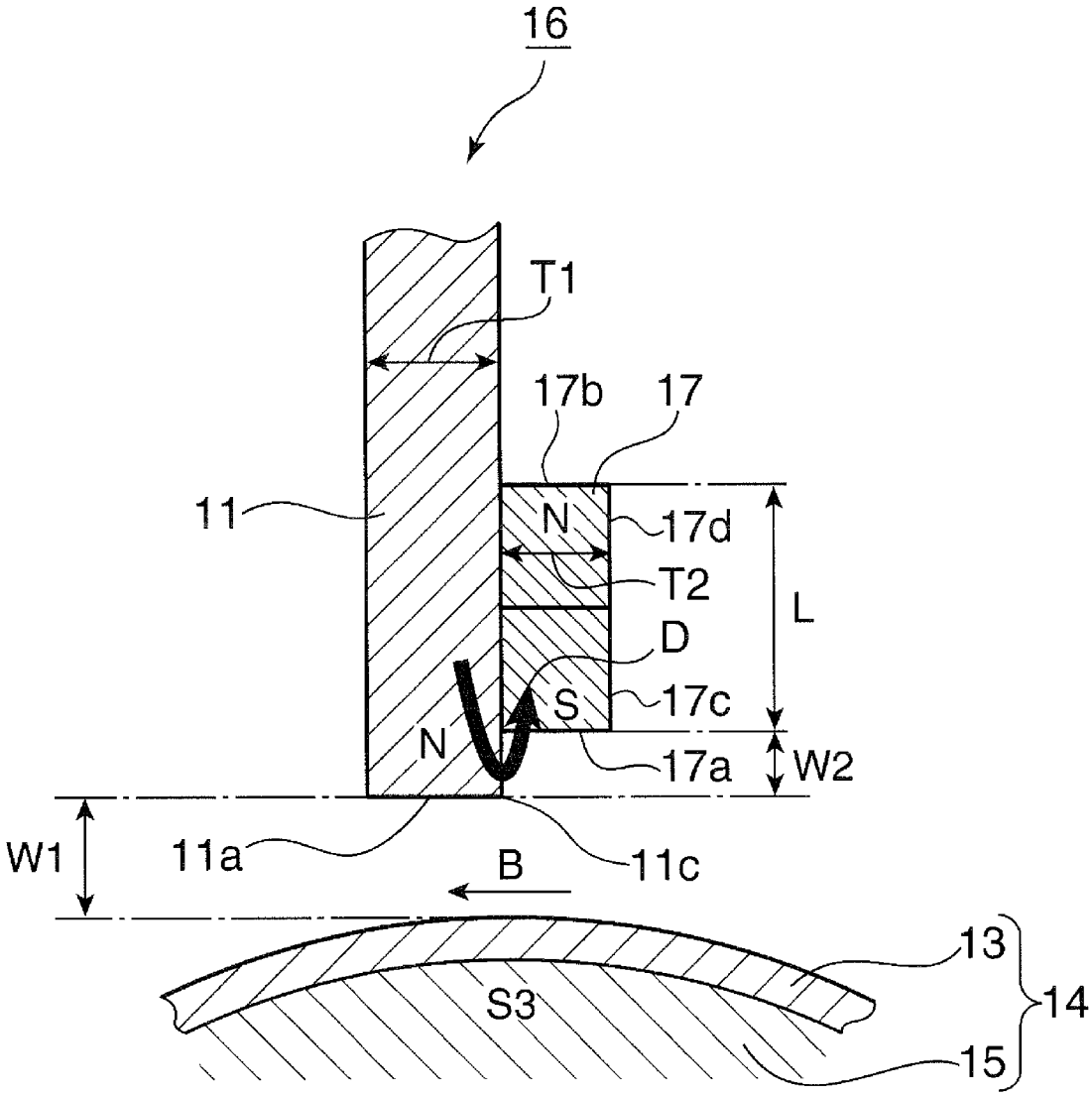
FIG. 6 is a partially enlarged cross section showing a developing roller and a toner layer thickness regulating member in a developing device according to a comparative embodiment.

FIG. 6 is a partially enlarged cross section showing the developing roller 14 and the toner layer thickness regulating member 16 in the developing device 20. A magnet 17 attached to the blade 11 has an S pole, which has a polarity same as that of the magnetic pole (blade pole S3) formed in a portion of the stationary magnet 15 included in the developing roller 14 so as to oppose the blade 11, on the end surface 17*a* on the rotary sleeve side and an N pole on the end surface 17*b* on the opposite side (the side farther from the rotary sleeve 13). The magnet 17 is therefore located in such a manner that the direction D of the magnetic field generated in a portion of the magnet 17 on the rotary sleeve side is almost perpendicular to the rotation direction B of the rotary sleeve 13.

Figure 7:
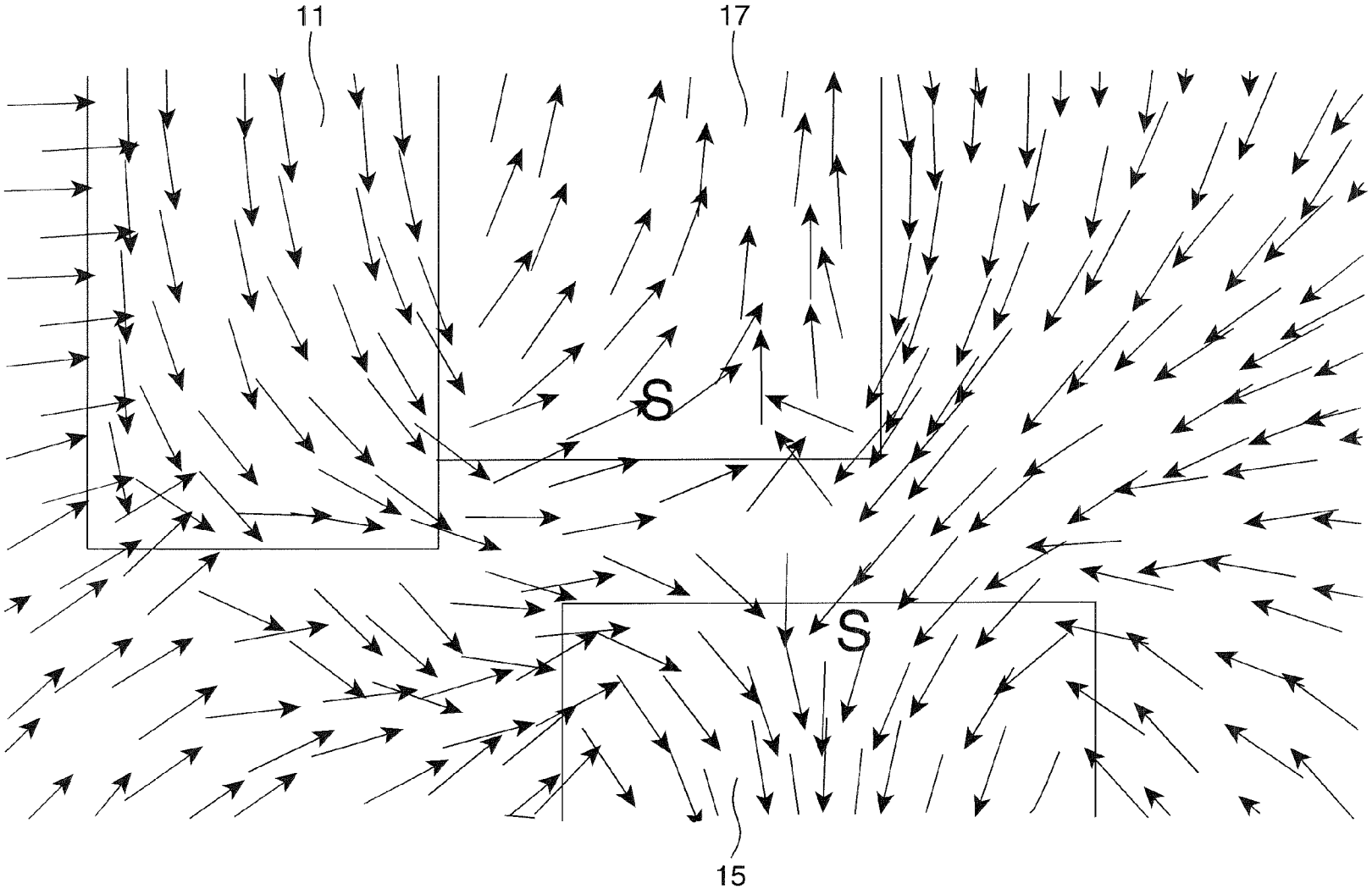
FIG. 7 is a view showing the result of the analysis on magnetic fields in a case where magnetic poles are formed in the positional relation as specified in FIG. 6.

FIG. 7 is a view showing the result of the analysis on the magnetic fields when the magnetic poles are formed in the positional relation specified in FIG. 6. As with FIG. 5, the magnetic fields were analyzed by making a distance between the magnet 17 and the stationary magnet 15 shorter than the actual distance. As can be understood from FIG. 7, the magnet 17 disposed in the positional relation as specified in FIG. 6 is disposed in such a manner that the direction D of the magnetic field generated in a portion of the magnet 17 on the rotary sleeve side is almost perpendicular to the rotation direction B of the rotary sleeve 13.

In the developing unit 20, a strong magnetic field is generated at the layer thickness regulating position by the S3 pole in the stationary magnet 15 and the S pole on the end surface 17*a* of the magnet 17 on the rotary sleeve side. In addition, as can be understood from the fact that the direction D of the magnetic field as described above is formed on the end surface 11*a* of the blade 11 on the rotary sleeve side, a strong N pole is induced. Because a magnetic field is generated in a portion of the magnet 17 on the rotary sleeve side in such a manner that the direction D of the magnetic field is almost perpendicular to the rotation direction B of the rotary sleeve 13, a strong magnetic pole is formed on the end surface 17*a* of the magnet 17 on the rotary sleeve side, which is a significant difference from the developing unit 10 described above.

In the developing unit 20, because a strong N pole is induced on the end surface 11*a* of the blade 11 on the rotary sleeve side, as with the developing unit 10, it is possible to form a toner layer having little irregularities in density. However, because a strong magnetic pole is formed on the end surface 17*a* of the magnet 17 on the rotary sleeve side, a large amount of toner particles adhere to the end surface 17*a* of the magnet 17 on the rotary sleeve side. Accordingly, in a case where the developing device 20 is used over a long period or at a high temperature, toner particles adhering to the magnet 17 may possibly aggregate to form clusters. When aggregated toner particles enter at the layer thickness regulating position, a part mixed with aggregated toner particles is in a condition that the layer thickness and the charging state of the toner layer are different from those in the other parts, which gives rise to the occurrence of a streak-like image defect.

Hereinafter, the magnetic flux density actually measured in the developing unit 10 according to one embodiment of the invention and in the developing unit 20 according to the comparative embodiment for the purpose of comparison with the invention will be described.

Figure 8:
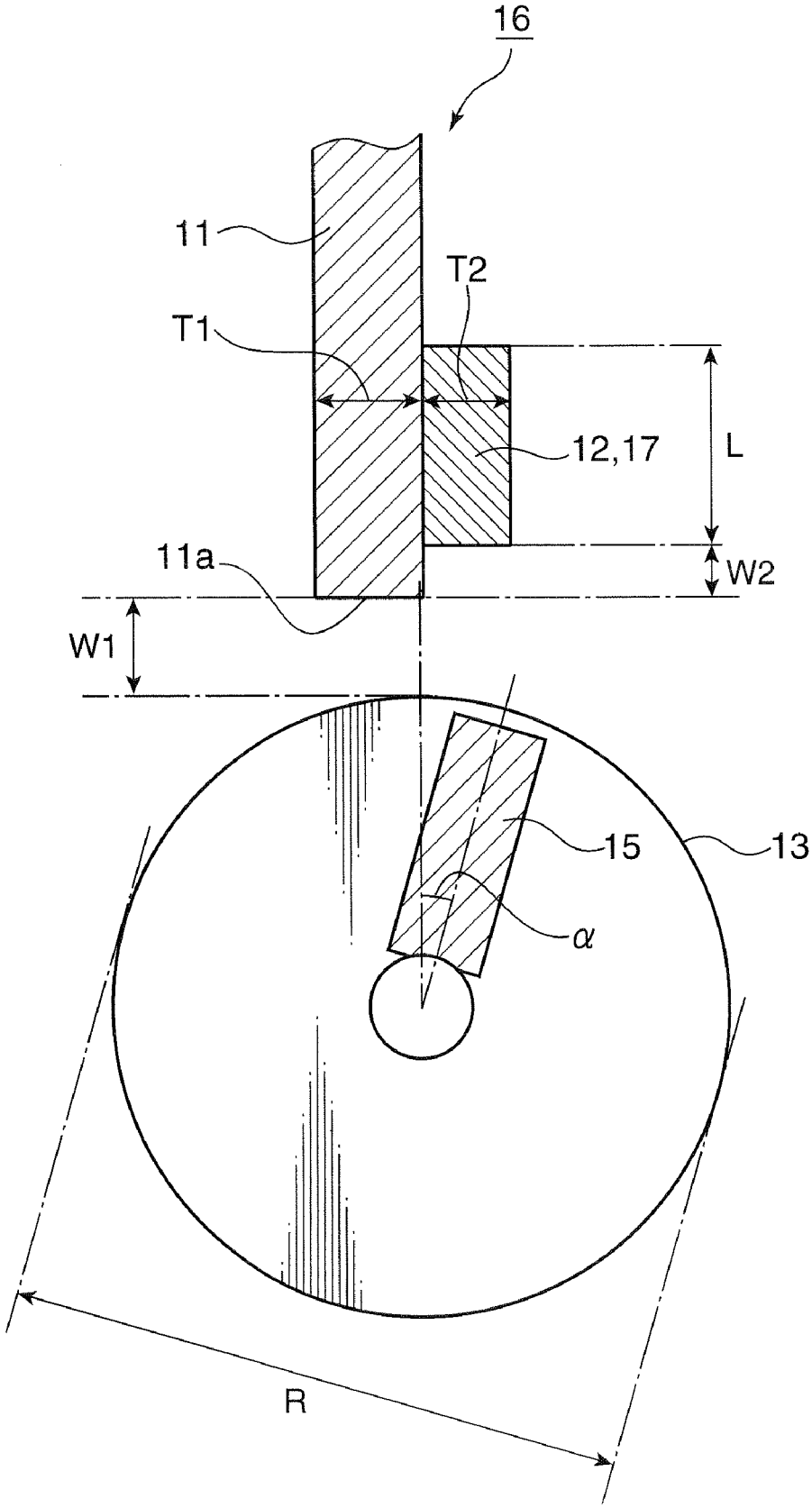
FIG. 8 is a partially enlarged cross section showing the developing roller and the toner layer thickness regulating member in the developing units according to one embodiment of the invention and the comparative embodiment when the magnetic flux density was measured.

FIG. 8 is a partially enlarged cross section showing the developing roller 14 and the toner layer thickness regulating member 16 in the developing units 10 and 20 in which the magnetic flux density was measured. The dimensions and the positional relations of the respective members in the developing units 10 and 20 in which the magnetic flux density was actually measured were as follows. The interval W1 between the end surface 11*a* of the blade 11 on the rotary sleeve side and the rotary sleeve 13 was 0.3 mm. The thickness T1 of the blade 11 was 2 mm. The protrusion length W2 of the blade 11 with respect to the magnet 12 or 17 was 0.5 mm. The magnets 12 and 17 had the thickness T2 of 4 mm and the length L of 5 mm, and the length in a direction in parallel with the shaft center direction of the developing roller 14 was 218 mm. The diameter R of the rotary sleeve 13 was 16 mm. The angle $\alpha$ between the plane direction of the blade 11 and the longitudinal direction of the stationary magnet 15 opposing the blade 11 was 4 degrees. The developing unit 10 and 20 employed a magnet of a 70 mT as the magnet 12, a magnet of a 70 mT as the magnet 17 and a magnet of 90 mT as the stationary magnet 15, and the magnetic flux density was measured under the measurement conditions as specified above (shapes and the positional relations). The magnetic flux density was measured using a Tesla meter.

In the developing unit 10 according to one embodiment of the invention, an N pole of 40 mT was formed on the edge 11*c* of the end surface 11*a* of the blade 11 on the rotary sleeve side upstream in the rotation direction of the rotary sleeve 13. An S pole of 70 mT was formed in the center portion on the end surface 12*c* of the magnet 12 on the open surface side. An S pole of 30 mT was formed in the center portion on the S pole side on the end surface 12*a* of the magnet 12 on the rotary sleeve side. Accordingly, it is understood that a strong magnetic pole was formed on the end surface 11*a* of the blade 11 on the rotary sleeve side but a strong magnetic pole was not formed on the end surface 12*a* of the magnet 12 on the rotary sleeve side in the developing unit 10.

In the developing unit 20 according to the comparative embodiment, an N pole of 40 mT was formed on the edge 11*c* of the end surface 11*a* of the blade 11 on the rotary sleeve side upstream in the rotation direction of the rotary sleeve 13. An N pole of 20 mT was formed in the center portion on the N pole side on the end surface 17*d* of the magnet 17 on the open surface side, and an S pole of 20 mT was formed in the center portion on the S pole side on the end surface 17*c* on the open surface side. An S pole of 70 mT was formed in the center portion on the end surface 17*a* of the magnet 17 on the rotary sleeve side. Accordingly, it is understood that a strong magnetic pole was formed on the end surface 11*a* of the blade 11 on the rotary sleeve side, and at the same time, a strong magnetic pole was also formed on the end surface 17*a* of the magnet 17 on the rotary sleeve side in the developing unit 20.

In view of the foregoing, in comparison with the developing unit 20 of the comparison embodiment, the developing device (developing unit) 10 of this embodiment is capable of maintaining almost the same magnetic force on the end surface 11*a* of the blade 11 on the rotary sleeve side while suppressing the magnetic force on the end surface 12*a* of the magnet 12 on the rotary sleeve side. Accordingly, by the operations as described above, the developing device (developing unit) 10 of this embodiment is not only capable of forming a toner layer having little irregularities in density, but is also capable of preventing the occurrence of an image defect, in particular, a streak-like image defect appearing in a half-tone image by reducing an amount of toner particles adhering to the end surface 12*a* of the magnet 12 on the rotary sleeve side.

The embodiment above described a magnetic mono-component developing device using a magnetic mono-component magnetic agent (magnetic toner particles). It should be appreciated, however, that the invention is not limited to this configuration, and similar advantages can be achieved as long as a developing device uses a magnetic developing agent. Examples of a magnetic developing agent include but not limited to a two-component developing agent containing magnetic toner particles and a non-magnetic carrier, a two-component developing agent containing non-magnetic toner particles and a magnetic carrier, and a two-component developing agent containing magnetic toner particles and a magnetic carrier.

The specific embodiment described above chiefly includes inventions having the following configurations.

A developing device using a magnetic mono-component developing agent according to one aspect of the invention includes a rotary sleeve that accommodates a stationary magnet, and a toner layer thickness regulating member that regulates a thickness of a toner layer formed on the rotary sleeve. The toner layer thickness regulating member includes a blade formed of a plate-like member made of a magnetic material, and a magnet attached to the blade on a side upstream in a rotation direction of the rotary sleeve. The magnet is disposed in such a manner that a direction of a magnetic field generated in a portion of the magnet on a side of the rotary sleeve is almost in parallel with the rotation direction of the rotary sleeve.

According to this configuration, it is possible to regulate the thickness of the toner layer formed thick on the rotary sleeve using the toner layer thickness regulating member, which allows the toner particles to be supplied to the image carrier from the toner layer whose layer thickness has been regulated.

In addition, because the magnet is attached to the blade formed of a plate-shaped member made of a magnetic material on the side upstream in the rotation direction of the rotary sleeve, the toner layer thickness regulating member is able to generate a strong magnetic field on the end surface of the blade on the rotary sleeve side. Accordingly, a strong magnetic force acts between the blade and the rotary sleeve, which makes the toner layer at the layer thickness regulating position least susceptible to the environment other than this magnetic force. Consequently, disturbance in the toner layer hardly occurs at the layer thickness regulating position. It is thus possible to form a toner layer having little irregularities in density even when the layer thickness is regulated.

In addition, the magnet is disposed in such manner that the direction of the magnetic field generated in the portion on the rotary sleeve side is almost in parallel with the rotation direction of the rotary sleeve. Hence, in comparison with a case where the magnet is disposed in such a manner that the direction of the magnetic field is perpendicular to the rotation direction of the rotary sleeve, even when the magnetic field generated on the end surface of the blade on the rotary sleeve side has about the same strength, the magnetic field generated on the end surface of the magnet on the rotary sleeve side is weak. Consequently, toner particles hardly adhere to the end surface of the magnet on the rotary sleeve side. It is thus possible to prevent the occurrence of an image defect resulting from aggregated toner particles.

As has been described, the developing device of the invention is not only capable of forming the toner layer having little irregularities in density, but is also capable of preventing the occurrence of an image defect.

In the configuration described above, to be more concrete, it is preferable that: the blade is disposed in a direction perpendicular to the rotation direction of the rotary sleeve; the magnet is a plate-like magnet to be disposed in parallel with a plane direction of the blade; and the plate-like magnet has a magnetization direction perpendicular to the plane direction of the blade.

According to this configuration, it is possible to dispose the magnet with ease in such a manner that the direction of the magnetic field generated in the portion of the magnet on the rotary sleeve side is almost in parallel with the rotary direction of the rotary sleeve. Hence, not only is it possible to form a toner layer whose layer thickness is regulated so as to have little irregularities in density, but it is also possible to prevent the occurrence of an image defect resulting from aggregated toner particles.

In the configuration described above, it is preferable that: the magnet has an end surface opposing the rotary sleeve; the blade has an end surface opposing the rotary sleeve; and the end surface of the magnet is at position farther from the rotary sleeve than the end surface of the blade.

According to this configuration, even when a small amount of toner particles adhere to the end surface of the magnet on the rotary sleeve side, toner particles hardly clog in a space between the blade and the rotary sleeve. It is thus possible to prevent the occurrence of an image defect resulting from the clogging of toner particles.

In the configuration described above, it is preferable that: the stationary magnet has a first magnetic pole disposed at a position opposing the toner layer thickness regulating member; and that the magnet has a second magnetic pole having a polarity different from a polarity of the first magnetic pole on a lamination surface side in contact with the blade and a magnetic pole having a polarity same as the polarity of the first magnetic pole on an open surface side not in contact with the blade.

According to this configuration, it is possible to dispose the magnet with more ease in such a manner that the direction of the magnetic field generated in the portion of the magnet on the rotary sleeve side is almost in parallel with the rotation direction of the rotary sleeve.

In the configuration described above, it is preferable that a distance between the rotary sleeve and the blade is 0.2 to 0.4 mm. According to this configuration, toner particles hardly clog in a space between the blade and the rotary sleeve, which makes it possible to form a suitable toner layer.

In the configuration described above, it is preferable that a length of the blade protruding with respect to the magnet is 0.3 to 0.8 mm. According to this configuration, even when a small amount of toner particles adhere to the end surface of the magnet on the rotary sleeve side, toner particles hardly clog in a space between the blade and the rotary sleeve. It is thus possible to prevent the occurrence of an image defect resulting from the clogging of toner particles.

Also, a developing device using a magnetic developing agent according to another aspect of the invention includes a rotary sleeve that accommodates a stationary magnet, and a developing agent layer thickness regulating member that regulates a thickness of a developing agent layer formed on the rotary sleeve. The developing agent layer thickness regulating member includes a blade formed of a plate-like member made of a magnetic material, and a magnet attached to the blade on a side upstream in a rotation direction of the rotary sleeve. The magnet is disposed in such a manner that a direction of a magnetic field generated in a portion of the magnet on a side of the rotary sleeve is almost in parallel with the rotation direction of the rotary sleeve.

In the configuration described above, to be more concrete, it is preferable that the blade is disposed in a direction perpendicular to the rotation direction of the rotary sleeve; the magnet is a plate-like magnet to be disposed in parallel with a plane direction of the blade; and the plate-like magnet has a magnetization direction perpendicular to the plane direction of the blade.

In the configuration described above, it is preferable that: the magnet has an end surface opposing the rotary sleeve; the blade has end surface opposing the rotary sleeve; and the end surface of the magnet is at a position farther from the rotary sleeve than an end surface of the blade.

In the configuration described above, it is preferable that: the stationary magnet has a first magnetic pole disposed at a position opposing the developing agent layer thickness regulating member; and that the magnet has a second magnetic pole having a polarity different from a polarity of the first magnetic pole on a lamination surface side in contact with the blade and a magnetic pole having a polarity same as the polarity of the first magnetic pole on an open surface side not in contact with the blade.

In the configuration described above, it is preferable that a distance between the rotary sleeve and the blade is 0.2 to 0.4 mm.

In the configuration described above, it is preferable that a length of the blade protruding with respect to the magnet is 0.3 to 0.8 mm.

Further, an image forming apparatus according to still another aspect of the invention includes an image carrier on which an electrostatic latent image is to be formed, and a developing device that develops the electrostatic latent image formed on the image carrier by supplying a magnetic mono-component developing agent to the image carrier. The developing device includes a rotary sleeve that accommodates a stationary magnet, and a toner layer thickness regulating member that regulates a thickness of a toner layer formed on the rotary sleeve. The toner layer thickness regulating member includes a blade formed of a plate-like member made of a magnetic material, and a magnet attached to the blade on a side upstream in a rotation direction of the rotary sleeve. The magnet is disposed in such a manner that a direction of a magnetic field generated in a portion of the magnet on a side of the rotary sleeve is almost in parallel with the rotation direction of the rotary sleeve.

According to this configuration, because the developing device as described above is incorporated into the image forming apparatus, the developing device is not only capable of forming a toner layer having little irregularities in density, but is also capable of preventing the occurrence of an image defect. the image forming apparatus is thereby able to form a high-quality image on a recording medium.

This application is based on patent application No. 2007-021011 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A developing device using a magnetic mono-component developing agent, comprising:

a rotary sleeve that accommodates a stationary magnet; and a toner layer thickness regulating member that regulates a thickness of a toner layer formed on the rotary sleeve, wherein the toner layer thickness regulating member includes:

a blade formed of a plate-like member made of a magnetic material; and a magnet attached to the blade on a side upstream in a rotation direction of the rotary sleeve, wherein the magnet is disposed in such a manner that a direction of a magnetic field generated in a portion of the magnet on a side of the rotary sleeve is almost in parallel with the rotation direction of the rotary sleeve, and wherein the blade is disposed in a direction perpendicular to the rotation direction of the rotary sleeve;

the magnet is a plate-like magnet to be disposed in parallel with a plane direction of the blade; and the plate-like magnet has a magnetization direction perpendicular to the plane direction of the blade.

2. The developing device according to claim 1, wherein:
the magnet has an end surface opposing the rotary sleeve;
the blade has an end surface opposing the rotary sleeve; and
the end surface of the magnet is at position farther from the rotary sleeve than the end surface of the blade.

3. The developing device according to claim 1, wherein:
the stationary magnet has a first magnetic pole disposed at a position opposing the toner layer thickness regulating member; and
the magnet has a second magnetic pole having a polarity different from a polarity of the first magnetic pole on a lamination surface side in contact with the blade and a magnetic pole having a polarity same as the polarity of the first magnetic pole on an open surface side not in contact with the blade.

4. The developing device according to claim 1, wherein:
a distance between the rotary sleeve and the blade is 0.2 to 0.4 mm.

5. The developing device according to claim 1, wherein:
a length of the blade protruding with respect to the magnet is 0.3 to 0.8 mm.

6. A developing device using a magnetic developing agent, comprising:
a rotary sleeve that accommodates a stationary magnet; and
a developing agent layer thickness regulating member that regulates a thickness of a developing agent layer formed on the rotary sleeve,
wherein the developing agent layer thickness regulating member includes:
a blade formed of a plate-like member made of a magnetic material; and
a magnet attached to the blade on a side upstream in a rotation direction of the rotary sleeve,
wherein the magnet is disposed in such a manner that a direction of a magnetic field generated in a portion of the magnet on a side of the rotary sleeve is almost in parallel with the rotation direction of the rotary sleeve, and
wherein the blade is disposed in a direction perpendicular to the rotation direction of the rotary sleeve;
the magnet is a plate-like magnet to be disposed in parallel with a plane direction of the blade; and
the plate-like magnet has a magnetization direction perpendicular to the plane direction of the blade.

7. The developing device according to claim 6, wherein:
the magnet has an end surface opposing the rotary sleeve;
the blade has an end surface opposing the rotary sleeve; and
the end surface of the magnet is at position farther from the rotary sleeve than the end surface of the blade.

8. The developing device according to claim 6, wherein:
the stationary magnet has a first magnetic pole disposed at a position opposing the developing agent layer thickness regulating member; and
the magnet has a second magnetic pole having a polarity different from a polarity of the first magnetic pole on a lamination surface side in contact with the blade and a magnetic pole having a polarity same as the polarity of the first magnetic pole on an open surface side not in contact with the blade.

9. The developing device according to claim 6, wherein:
a distance between the rotary sleeve and the blade is 0.2 to 0.4 mm.

10. The developing device according to claim 6, wherein:
a length of the blade protruding with respect to the magnet is 0.3 to 0.8 mm.

11. An image forming apparatus, comprising:
an image carrier on which an electrostatic latent image is to be formed; and
a developing device that develops the electrostatic latent image formed on the image carrier by supplying a magnetic mono-component developing agent to the image carrier,
wherein the developing device includes:
a rotary sleeve that accommodates a stationary magnet; and
a toner layer thickness regulating member that regulates a thickness of a toner layer formed on the rotary sleeve,
wherein the toner layer thickness regulating member includes:
a blade formed of a plate-like member made of a magnetic material; and
a magnet attached to the blade on a side upstream in a rotation direction of the rotary sleeve,
wherein the magnet is disposed in such a manner that a direction of a magnetic field generated in a portion of the magnet on a side of the rotary sleeve is almost in parallel with the rotation direction of the rotary sleeve, and
wherein the blade is disposed in a direction perpendicular to the rotation direction of the rotary sleeve;
the magnet is a plate-like magnet to be disposed in parallel with a plane direction of the blade; and
the plate-like magnet has a magnetization direction perpendicular to the plane direction of the blade.

12. The image forming apparatus according to claim 11, wherein:
the magnet has an end surface opposing the rotary sleeve;
the blade has an end surface opposing the rotary sleeve; and
the end surface of the magnet is at position farther from the rotary sleeve than the end surface of the blade.

13. The image forming apparatus according to claim 11, wherein:
the stationary magnet has a first magnetic pole disposed at a position opposing the toner layer thickness regulating member; and
the magnet has a second magnetic pole having a polarity different from a polarity of the first magnetic pole on a lamination surface side in contact with the blade and a magnetic pole having a polarity same as the polarity of the first magnetic pole on an open surface side not in contact with the blade.

14. The image forming apparatus according to claim 11, wherein:
a distance between the rotary sleeve and the blade is 0.2 to 0.4 mm.

15. The image forming apparatus according to claim 11, wherein:
a length of the blade protruding with respect to the magnet is 0.3 to 0.8 mm.

* * * * *